United States Patent [19]

Bubik et al.

[11] 4,447,295

[45] May 8, 1984

[54] DEWATERING APPARATUS FOR LONGITUDINAL WIRE PAPERMAKING MACHINES

[75] Inventors: Alfred Bubik; Hans Dahl; Herbert Holik, all of Ravensburg; Rüdiger Kurtz, Immenstaad; Werner Seider, Ravensburg, all of Fed. Rep. of Germany

[73] Assignee: Escher Wyss GmbH, Ravensburg, Fed. Rep. of Germany

[21] Appl. No.: 392,622

[22] Filed: Jun. 28, 1982

[30] Foreign Application Priority Data

Jul. 24, 1981 [CH] Switzerland ..... 4824/81

[51] Int. Cl.[3] ..... D21F 1/36; D21F 1/40

[52] U.S. Cl. ..... 162/300; 162/352

[58] Field of Search ..... 162/203, 300, 301, 352

[56] References Cited

U.S. PATENT DOCUMENTS

| | | | |
|---|---|---|---|
| 3,726,758 | 4/1973 | Parker et al. | 162/301 X |
| 3,992,253 | 11/1976 | Schiel | 162/301 X |
| 3,994,774 | 11/1976 | Halme | 162/301 X |
| 4,033,812 | 7/1977 | Riihinen | 162/352 X |
| 4,176,005 | 11/1979 | Bubik et al. | 162/300 X |
| 4,220,502 | 9/1980 | Levanen | 162/300 X |

*Primary Examiner*—Richard V. Fisher

*Attorney, Agent, or Firm*—Werner W. Kleeman

[57] ABSTRACT

A dewatering apparatus contains a longitudinal wire and an additional wire which is guided, conjointly with the longitudinal wire, along a section of such longitudinal wire over a domed or arched surface. This domed or arched surface is formed, for instance, by the jacket or outer surface of a dewatering cylinder arranged within the wire loop of the longitudinal wire. The longitudinal wire is provided with a headbox and extends forwardly and after the dewatering apparatus essentially in a wire plane, above which upwardly rises the domed surface. Both of the wires are guided out of the wire plane over a dewatering shoe arranged within the wire loop of the additional wire towards the domed surface and from such—if desired over a deflection roll arranged beneath the wire plane—again towards the wire plane, where both wires separate from one another. Due to this arrangement there is realized a guiding of both wires which improves the dewatering action and is extensively independent of the elevational position of the wire plane, and at the same time affords a constructional simplification of the papermaking machine.

14 Claims, 4 Drawing Figures

DEWATERING APPARATUS FOR LONGITUDINAL WIRE PAPERMAKING MACHINES

BACKGROUND OF THE INVENTION

The present invention relates to a new and improved construction of a dewatering apparatus for longitudinal wire papermaking machines.

Generally speaking, the dewatering apparatus for a longitudinal wire papermaking machine comprises a longitudinal wire and an additional wire guided over guide elements. The additional wire is guided conjointly with the longitudinal wire, along a section or portion of the longitudinal wire, over a domed surface. The longitudinal wire extends essentially in the same wire plane before and after the dewatering apparatus.

A papermaking machine of this type has been disclosed in the commonly assigned, copending U.S. application Ser. No. 06/321,677, filed Nov. 16, 1981. With the longitudinal wire papermaking machine described in this copending application the longitudinal wire and the additional wire are guided along a common dewatering path over a dewatering shoe arranged at the height of the wire plane within the wire loop of the longitudinal wire and over a dewatering roll arranged after such dewatering shoe in the direction of movement of the longitudinal wire downwardly out of the wire plane, and thereafter over a contact or travel surface of a deflection roll arranged within the wire loop of the additional wire back towards the wire plane, where both of the wires separate from one another. This arrangement unites the advantages of a simple construction of a longitudinal wire machine with the advantages of the particularly intensive dewatering and the improved sheet formation of a twin-wire papermaking machine, as such has been disclosed, for instance, in U.S. Pat. No. 4,176,005, granted Nov. 27, 1979.

SUMMARY OF THE INVENTION

It is a primary object of the present invention, as a further development of the previously described construction, to obtain at a papermaking machine of the previously mentioned type a further improvement in the dewatering action as well as a further constructional simplification of the machine structure, especially a reduction in the structural height of the papermaking machine.

This object and others which will become more readily apparent as the description proceeds, are effectively solved according to the invention in that, there is provided an arrangement wherein the domed or arched surface rises upwardly past the wire plane.

The inventive arrangement results in a still simpler construction of the papermaking machine in contrast to prior designs. In particular, on the one hand, there are possible constructions having a still lower or compacter structural height than was heretofore possible, and there is rendered possible guiding of the common section or portion of both wires practically independent of the elevational position of the wire plane. On the other hand, there is realized an improved accessiblity of the sections or portions of both wires which extend practically in an open condition above the wire plane. The inventive arrangement is also particularly suitable for retrofitting or converting an existing longitudinal wire papermaking machine, since all of the appreciable structural changes can be undertaken at the region above the wire plane which is readily accessible.

According to a particularly simple design of the present invention, which advantageously requires very few changes in the conventional concept of a longitudinal wire papermaking machine, the domed or arched surface can be located at a cylinder which is arranged within the wire loop of the longitudinal wire. This arrangement, even with a low structural height of the papermaking machine, allows the installation of a dewatering cylinder having a relatively large diameter.

According to another embodiment of the present invention the domed surface can be arranged at a shoe or shoe member. This shoe is located within the wire loop of the longitudinal wire. Consequently, with a relatively small deflection of the common section of both wires out of the wire plane, and thus, with an advantageously slight action upon the guiding of the longitudinal wire, it is possible to realize in conventional manner an appreciably larger guide surface for both wires in relation to the use of a cylinder surface.

According to a still further construction of the present invention both of the wires, the longitudinal wire and the additional wire, can be joined or brought together at the domed surface and also can separate or depart from one another at the domed surface. Consequently, there can be realized a particularly compact arrangement of the dewatering apparatus, especially a simplified guiding of the additional wire.

In order to obtain in the direction of movement of both wires as long as possible common section or portion, and thus, as intensely as possible dewatering action, it is advantageous if both of the wires, the longitudinal wire and the additional wire, are joined together and separated from one another, respectively, by guide elements arranged forwardly and/or after the domed surface.

A particularly simple wire guide arrangement, which enhances the dewatering operation, can be realized if at least one of the guide elements intended for bringing together or separating, as the case may be, both of the wires, contains a suction box which possesses a suction and guide surface for both wires which is concave with respect to the longitudinal wire.

According to a further design of the present invention it is possible, while incorporating the space located below the wire plane into the guiding of the common section or portion of both wires, to increase in a most simple manner its wrap angle at the domed or arched surface in that, both wires, following the domed surface, are guided over a further domed or arched surface which extends below the wire plane.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
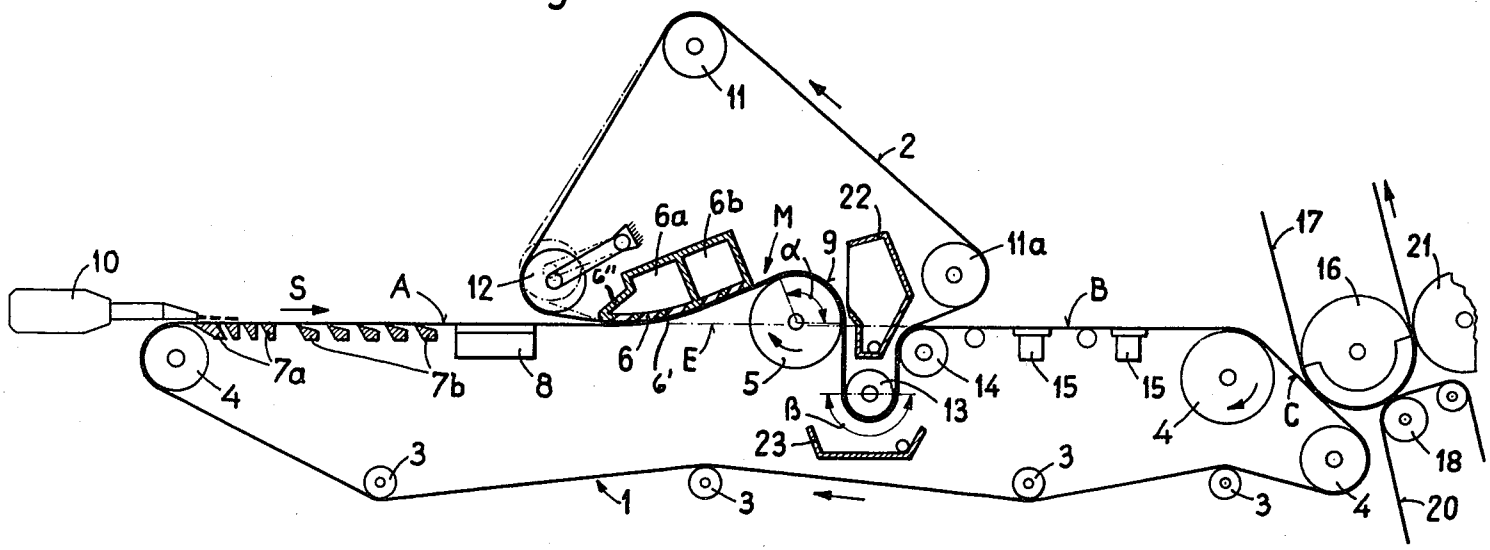
FIG. 1 schematically illustrates a longitudinal wire papermaking machine equipped with a dewatering apparatus constructed according to the invention, wherein the lower wire, before and after the dewatering apparatus, travels essentially in one plane.

Describing now the drawings, it is to be understood that only enough of the construction of the papermaking machine has been illustrated in the drawings to simplify the showing thereof, and as will enable those skilled in the art to readily understand the underlying principles and concepts of the present development. Turning attention now specifically to FIG. 1, there is illustrated therein a papermaking machine which will be seen to contain an endless lower wire or sieve band 1 which is constructed as a longitudinal wire, and an endless upper additional wire or sieve band 2 which travels along an intermediate section or portion M of the lower wire 1 and forms in conjunction therewith a dewatering path or zone. The lower longitudinal wire 1, which travels during the operation of the equipment in the direction of movement indicated by the arrow S, is guided over guide rolls 3 and guide cylinders 4. The portion of the lower longitudinal wire 1, confronting the upper additional wire 2, is guided in a substantially flat or planar section A, extending substantially horizontally and located before or upstream of the common section M, with respect to its direction of movement indicated by the aforementioned arrow S, over suitable dewatering elements, such as typically for instance wire tables 7*a*, foils 7*b* and suction boxes 8, and in a substantially flat or planar section B, likewise extending substantially horizontally and merging with the section M and following the same is guided over a deflection roll 14 and further suitable dewatering devices, such as for instance suction boxes 15. The sections or portions A and B are located in a common wire plane E.

At the region of the intermediate section or portion M the lower longitudinal wire 1, together with the thereat contacting portion of the upper additional wire 2, are guided over a substantially cylindrically downwardly domed travel or contact deflecting surface 6' of a dewatering or slide shoe 6, a dewatering surface 9 formed at a cylinder 5 arranged after the dewatering or slide shoe 6 in the direction of movement of the lower longitudinal wire 1 indicated by the mentioned arrow S, and a further domed surface defined at a deflection roll 13 arranged between such cylinder 5 and a deflection roll 14 and disposed below the wire plane E. The dewatering roll 5 is arranged within the endless wire loop of the lower longitudinal wire 1 such that its jacket or outer or dewatering surface 9 extends upwardly beyond the wire plane E. At the starting region of the planar section A there is located a headbox 10 which, in conventional manner, serves for the distribution of a fiber stock suspension onto the lower longitudinal wire 1 and for forming a fiber web upon such wire.

The dewatering slide shoe 6 and the deflection roll 13 are arranged within the endless wire loop of the upper additional wire 2, which is guided externally of the common section or portion M over guide rolls 11*a*, 11 and an adjustment roll 12. The adjustment roll 12 and, if desired, the dewatering slide shoe 6 can be adjusted transversely with respect to the wire plane E by any suitable adjustment positioning means. The adjustment roll 12, in a manner well known from the aforementioned U.S. Pat. No. 4,176,005, serves for adjusting the run-on or inbound point of the upper wire 2 at the lower longitudinal wire 1 at the region of the dewatering slide shoe 6. This dewatering slide shoe or slide shoe member 6 is equipped with a suction box 6'' composed of two mutually separated chambers 6*a* and 6*b*. The deflection roll 13 is wrapped by both of the wires 1 and 2 conjointly along a wrap angle $\beta$, and thus, ensures for wrapping of the dewatering cylinders through an angle $\alpha$.

The deflection roll 14 serves as the separation roll for separating the upper additional wire 2 from the lower longitudinal wire 1. This lower longitudinal wire 1 is joined together at a section C of its course of travel, which merges with the planar section B, with a felt band or felt 17 which trains about a suction press roll 16. The felt 17 serves for the pick-up or removal of the formed paper web from the longitudinal wire 1. The suction press roll 16 coacts with a counter roll 18, over which there is guided a wire 20, as well as with a counter roll 21.

The dewatering cylinder 5 and the deflection roll 13 have operatively associated therewith catch containers or vats 22 and 23 for the filtered or expelled water which is formed during the dewatering operation.

In accordance with the illustration of the dewatering apparatus of the papermaking machine depicted in FIG. 1, the fiber web which is formed by the headbox 10 is initially downwardly dewatered in conventional manner at the planar section or portion A forming a predewatering path, preferably with increasing intensity. From this region or portion A the formed fiber web, depending upon the position of the adjustment roll 12 and/or the dewatering or slide shoe 6, arrives between both wires 1 and 2, and is upwardly dewatered at the region of the dewatering or slide shoe 6 and subsequently at the region of the wrap angle $\alpha$ of the dewatering cylinder 5. In the second chamber 6*b* of the suction box 6'' there can be set a higher negative pressure than in the first chamber 6*a*, so that there is realized a further progressive increase in the dewatering intensity in the direction of movement, likewise indicated by the arrow S, of the fiber web. As a function of the momentarily set wire tension there also can be obtained at the region of the wrap angle $\alpha$ a further increase in the dewatering intensity, as may be required for the formation of the paper web. Following the dewatering cylinder 5 both of the wires 1 and 2 together with the intermediately situated fiber web are deflected—in opposite sense to the deflection accomplished by the dewatering cylinder 5—conjointly by the action of the deflection roll 13 through the wrap angle $\beta$ and guided over the deflection roll 14. The fiber web, after separation or de-contact of both wires 1 and 2 from one another, remains deposited upon the lower longitudinal wire 1. After further dewatering at the planar section or portion B the formed paper web is picked-off at the section or portion C from the wire 1 by the action of the suction press roll 16 and transferred to a pressing device or unit which contains the rolls 16, 18 and 21.

The construction of the machine depicted in FIG. 1 allows guiding, in a most simple manner, both of the wires 1 and 2 through relatively large wrap angles $\alpha$ and $\beta$, which are particularly favorable for the dewatering operation, over the dewatering cylinder 5 and the deflection roll 13, respectively, without deviating to any great degree from the essentially horizontal extent of the machine, and, in particular, without impairing the advantageous low structural height and simple construction of the remaining parts of the longitudinal wire papermaking machine. In corresponding manner it is possible to carry out with very simple means also retrofitting or conversion of the equipment.

Figure 2:
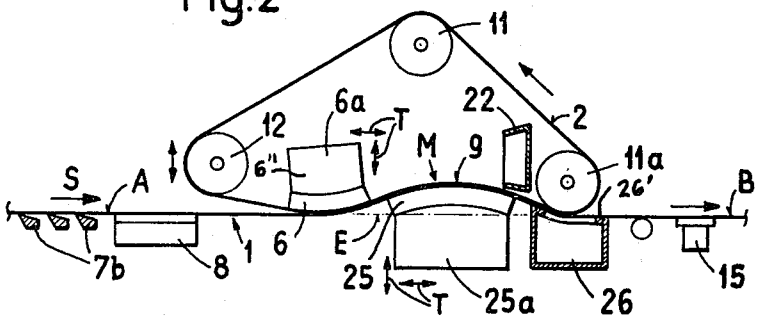
FIG. 2 is a sectional detail of a papermaking machine, corresponding to the showing of FIG. 1, illustrating a further embodiment of dewatering apparatus.

Continuing, reference will now be made to the further embodiments depicted in FIGS. 2, 3 and 4, and it is to be noted that in these additional embodiments there have been generally conveniently used the same reference characters to denote the same or analogous components.

Turning attention now to the embodiment depicted in FIG. 2, both of the wires or sieve bands 1 and 2 are guided over a first dewatering or slide shoe 6, the suction box 6'' of which can consist of a single chamber 6*a*, and the domed travel or contact surface 9 of a second dewatering shoe 25 arranged within the wire loop of the longitudinal wire 1, and then subsequently over a suction box 26 constituting a slide shoe and containing, with respect to the wire 1, a concave, in part open suction and guide surface 26'. Above the suction and guide surface 26' of the suction box 26 there is arranged the guide roll 11*a*. This guide roll 11*a* at the same time serves as the separation roll for separating the wire 2 from the wire 1 extending along the suction surface 26' at the planar section or portion B. The dewatering or slide shoes 6 and 25, in accordance with the indicated arrows T, are each adjustable in the direction of the extend of travel of the wires and/or transversely thereto. The dewatering shoe 25 is provided with a suction box 25*a*. In appropriate manner there is thus downwardly dewatered the fiber web located between the wires 1 and 2 at the region of the second dewatering shoe 25 and the suction box 26. This design renders possible, because of the large wrap angle formed at the region of the second dewatering shoe 25, a particularly intensive dewatering of the fiber web which passes through the common wire section M accompanied by a particularly slight deviation of the wire guiding from the essentially horizontal extent of the portion of the longitudinal wire 1 carrying the fiber web and which is otherwise conventional in longitudinal papermaking machines. It should be understood that, also with this embodiment, all or one of the suction boxes 6'', 25*a* and 26 can consist of a number of chambers which are at different negative pressures.

Figure 3:
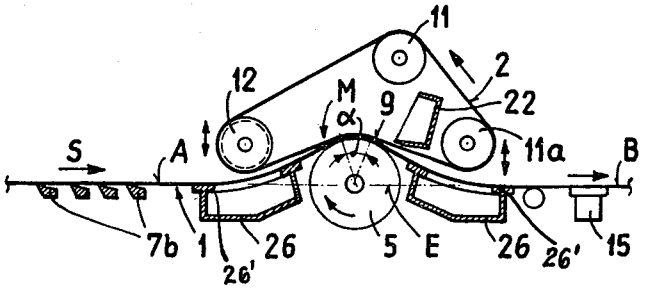
FIG. 3 is a sectional detail of a papermaking machine, corresponding to the showing of FIG. 1, illustrating a still further embodiment of dewatering apparatus.

With the embodiment of FIG. 3 the dewatering cylinder 5 is arranged between two suction boxes 26, constituting slide shoes the concave guide surfaces 26' of which each respectively support the portion or section of the longitudinal wire 1 extending from the planar section A towards the domed or arched jacket surface 9 of the dewatering cylinder 5 and the portion of the longitudinal wire 1 extending from such dewatering cylinder 5 towards the planar section B, respectively. The adjustment roll 12 and the guide roll 11*a*, which likewise can be adjustable transversely to the direction of wire travel, are each arranged at such a spacing over the suction boxes 26 that both wires 1 and 2 merge or join together at the domed jacket or outer dewatering surface 9 of the dewatering cylinder 5 and again separate at such outer surface 9, following the common wrapping of the dewatering cylinder 5 by these wires 1 and 2. By appropriately adjusting or setting the adjustment roll 12 and/or the guide roll 11*a* both of the wires 1 and 2 also can be joined or brought together and separated, respectively, in each case over the related suction box 26. The adjustment roll 12 can be designed as an open roll which possesses a grooved or furrowed surface indicated in FIG. 3 by the broken line inner circle, for instance in the form of a so-called honeycomb structure.

The fiber web which is located upon the longitudinal wire 1 is downwardly dewatered at the region of the suction boxes 26, and is upwardly dewatered at the region of the wrap angle $\alpha$. The embodiment of FIG. 3 manifests itself by virtue of its particularly compact construction which, in turn, renders possible an especially simple retrofitting of existing papermaking machines.

Figure 4:
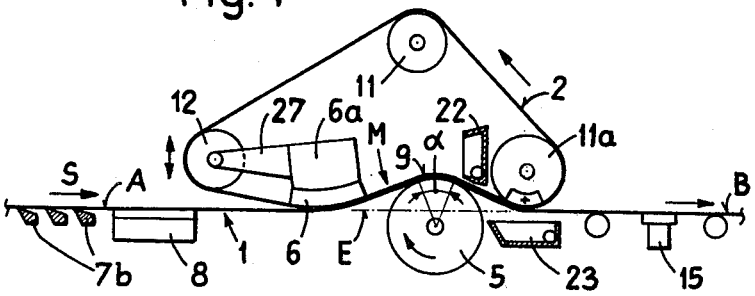
FIG. 4 is a sectional detail of a papermaking machine, corresponding to the showing of FIG. 1, illustrating yet another embodiment of dewatering apparatus.

As will be apparent from the further embodiment of dewatering apparatus for a longitudinal wire papermaking machine as depicted in FIG. 4, the adjustment or setting roll 12 can be mounted upon supports or carriers 27 fixedly connected with the dewatering shoe or shoe member 6, and thus, can be adjusted in conjunction with the dewatering shoe 6 relative to the longitudinal wire 1. The guide roll 11*a* of the upper wire 2 can be constructed as a pressure roll and can be arranged with its lower jacket or outer surface essentially in the wire plane E, so that the fiber web which outbounds or travels away at the region of the dewatering cylinder 5 can be still downwardly dewatered prior to separation of both of the wires 1 and 2.

There are also possible still different constructions of the invention. Thus, for instance, with all of the heretofore described exemplary embodiments the dewatering cylinder 5, as is known for instance from the previously mentioned U.S. Pat. No. 4,176,005, or one of the deflection rolls 13, 14 (FIG. 1), can be provided either with a solid jacket or outer surface or with a jacket or outer surface provided with recesses, or however can be constructed as a suction cylinder or suction roll. Equally, all or one of the dewatering shoes 6 and 25 can possess in each case a solid travel or contact surface and/or can be equipped with openings or slots. As to the dewatering shoe 25 arranged within the wire loop of the lower wire 1, as shown in the arrangement of FIG. 2, if desired there also can omitted the suction box 25*a*.

While there are shown and described present preferred embodiments of the invention, it is to be distinctly understood that the invention is not limited thereto, but may be otherwise variously embodied and practiced within the scope of the following claims. Accordingly,

What we claim is:

1. A dewatering apparatus for a longitudinal wire papermaking machine comprising:

a longitudinal wire;

an additional wire cooperating with said longitudinal wire;

guide elements over which there is guided said additional wire;

means defining a domed surface over which there is guided said additional wire along a section of the longitudinal wire in conjunction with said longitudinal wire;

said longitudinal wire extending substantially horizontally and essentially in a common wire plane forward of the guide elements and after the means defining the domed surface; and said means defining said domed surface upwardly rising past the common wire plane.

2. The dewatering apparatus as defined in claim 1, wherein:

said means defining said domed surface comprises a cylinder at which there is located said domed surface; and said cylinder being arranged within a wire loop of said longitudinal wire.

3. The dewatering apparatus as defined in claim 1, wherein:

said means defining said domed surface comprises a shoe at which there is located said domed surface; and said shoe being located within a wire loop of the longitudinal wire.

4. The dewatering apparatus as defined in claim 1, wherein:

both of said wires constituting said longitudinal wire and said additional wire are joined together at said domed surface and are again separated from one another at said domed surface.

5. The dewatering apparatus as defined in claim 1, wherein:

both of said wires constituting said longitudinal wire and said additional wire are joined together and again separated from one another by at least predetermined ones of said guide elements which are arranged forwardly and/or after the domed surface.

6. The dewatering apparatus as defined in claim 5, wherein:

at least one of said guide elements contains a suction box intended for joining together both of said wires; and said suction box possessing a suction and guide surface for both wires which is concave with respect to the longitudinal wire.

7. The dewatering apparatus as defined in claim 1, wherein:

at least one of said guide elements contains a suction box intended for separating both of said wires; and said suction box possessing a suction and guide surface for both wires which is concave with respect to the longitudinal wire.

8. The dewatering apparatus as defined in claim 1, wherein:

said domed surface defines a first domed surface;

means defining a further domed surface at which there are guided both of said wires following the first domed surface; and said further domed surface extending below the common wire plane.

9. A longitudinal wire papermaking machine comprising:

a longitudinal wire extending essentially in a common wire plane forward of and after a dewatering surface;

an additional wire cooperating with said longitudinal wire;

guide elements over which there is guided said additional wire;

means defining a deflecting surface including suction means operatively connected with said deflecting surface and provided with a downwardly domed surface at which at least said longitudinal wire is deflected upwardly and out of said common wire plane;

said means defining said deflecting surface forming a fixedly arranged slide shoe;

means defining said dewatering surface which includes an upwardly domed surface rising above said common wire plane and returningly guiding at least said longitudinal wire to said common wire plane;

said slide shoe being located upstream and in spaced relationship from said dewatering surface as seen in a predetermined running direction of said longitudinal wire; and said additional wire being guided by said guide elements to extend conjointly with a section of said longitudinal wire over said upwardly domed surface.

10. The apparatus as defined in claim 9, wherein:

said additional wire forms a loop; and said slide shoe being arranged within said loop.

11. The apparatus as defined in claim 9, wherein:

said longitudinal wire forms a loop;

said slide shoe being arranged within said loop formed by said longitudinal wire; and said deflecting surface being concavely domed relative to said longitudinal wire.

12. The apparatus as defined in claim 11, wherein:

said longitudinal wire and said additional wire are guided to join at least in the region of said dewatering surface at a distance from said slide shoe.

13. The apparatus as defined in claim 9, wherein:

said dewatering surface is formed at a fixedly arranged additional slide shoe.

14. The apparatus as defined in claim 11, further including:

means defining a further domed surface at which said longitudinal wire and said additional wire are guided in a joined state thereof;

said further domed surface following said dewatering surface as seen in said predetermined running direction of said longitudinal wire; and said further domed surface extending below said common wire plane.

* * * * *